US005339899A

United States Patent [19]

Ravi et al.

[11] Patent Number: 5,339,899

[45] Date of Patent: Aug. 23, 1994

[54] DRILLING FLUID REMOVAL IN PRIMARY WELL CEMENTING

[75] Inventors: Kris M. Ravi, Duncan, Okla.; Fred L. Sabins, Missouri City, Tex.

[73] Assignee: Halliburton Company, Duncan, Okla.

[21] Appl. No.: 127,843

[22] Filed: Sep. 28, 1993

Related U.S. Application Data

[63] Continuation-in-part of Ser. No. 939,197, Sep. 2, 1992, abandoned.

[51] Int. Cl.[5] ..... E21B 47/00

[52] U.S. Cl. ..... 166/250; 166/285

[58] Field of Search ..... 166/250, 285

[56] References Cited

U.S. PATENT DOCUMENTS 4,807,469 2/1989 Hall .

OTHER PUBLICATIONS

"Petroleum Engineering", Chapter 7, pp. 94–107, Carl Gatlin, Prentice-Hall Inc.

"Applied Drilling Engineering", pp.144–155, by Bourgone, Jr., et al., SPE.

Technical Paper, SPE 19539, "New Friction Correlation for Cements From Pipe and Rotational Viscometer Data" by S. N. Shah and D. L. Sutton, Oct. 1–11, 1989.

Perry's Chemical Engineers' Handbook, Editor, Don W. Green, pp. 5-23–5-26, McGraw-Hill '84.

*Transport Phenomena,* R. Byron Bird, et al., Department of Chemical Engineering, pp. 3–7, New York, '60.

*Primary Examiner*—Ramon S. Britts

*Assistant Examiner*—Frank S. Tsay

*Attorney, Agent, or Firm*—Robert A. Kent; Thomas R. Weaver; C. Clark Dougherty, Jr.

[57] ABSTRACT

The present invention relates to methods of ensuring the maximum removal of drilling fluid from a well bore including gelled drilling fluid and filter cake deposited on the walls of the well bore prior to placing cement in the well bore between a pipe disposed therein and the walls thereof. The methods basically comprise circulating the drilling fluid through the well bore while monitoring the drilling fluid pressure, flow rate, viscosity, temperature and density. The circulating volume of drilling fluid in the well bore is then calculated and compared with the total volume available in the well bore to determine the volume of drilling fluid remaining on the walls of the well bore.

20 Claims, No Drawings

DRILLING FLUID REMOVAL IN PRIMARY WELL CEMENTING

CROSS-REFERENCE TO RELATED APPLICATION

This is a continuation-in-part of prior copending application Ser. No. 07/939,197, filed Sep. 2, 1992, now abandoned.

BACKGROUND OF THE INVENTION

1. Field of the Invention

The present invention relates generally to primary well cementing, and more particularly, to methods of removing drilling fluid deposits from the walls of a well bore prior to placing cement therein.

2. Description of the Prior Art

A variety of drilling fluids are used in drilling well bores. Generally, the drilling fluids are solids-containing water base gels or hydrocarbon base fluids which can contain particulate weighting material such as barite. When a well bore is being drilled a drilling fluid is circulated through the well bore; when the drilling is completed, the circulation of the drilling fluid is stopped, the well is logged and pipe is run into the well bore. During the period when no circulation occurs, filter cake and partially dehydrated gelled drilling fluid are deposited on the walls of the well bore. The partially dehydrated gelled drilling fluid is formed from drilling fluid adjacent the walls of the well bore which loses a portion of its water and which develops gel strength in the absence of shear caused by the lack of circulation. Drilling fluid adjacent the partially dehydrated drilling fluid also develops gel strength in the absence of shear caused by the lack of circulation.

After pipe is run in the well bore, primary cementing operations are performed wherein the pipe is cemented in the well bore by placing a cement slurry in the annulus between the pipe and the walls of the well bore. When the cement slurry is run into the annulus, drilling fluid is displaced from the well bore. The cement slurry sets into a hard impermeable mass whereby the annulus is sealed.

In order for a primary cementing operation to be successful, it is preferred that all of the gelled drilling fluid and at least a major portion of the partially dehydrated gelled drilling fluid and filter cake deposited on the walls of the well bore be removed. If too much drilling fluid and filter cake deposits remain on the walls of the well bore, the cement will not properly bond thereto and fluid leakage through the well bore and other major problems will result.

Heretofore, attempts have been made to condition the drilling fluid in the well bore after logging and running pipe by circulating the drilling fluid through the well bore while removing drilling solids therefrom. It is believed that such circulation causes the erosion and thus facilitates the removal of a major portion of the gelled and partially dehydrated gelled drilling fluid and filter cake from the walls of the well bore. To estimate the quantity of material removed, attempts have been made to measure the circulating volume of drilling fluid in the well bore and then, by comparing that measurement with the total volume available in the well bore for drilling fluid, an estimate of the drilling fluid deposits remaining on the walls of the well bore is obtained.

Prior art techniques for determining the volume of circulating drilling fluid have involved combining marker fluids or materials with the circulating drilling fluid at the surface and measuring the time required for the marker to flow through the well bore and reappear at the surface. The time has been multiplied by the pumping rate of the drilling fluid being circulated to estimate the circulating volume. Examples of marking fluids and materials which have been used are oil based paints, calcium carbide pills, lightweight solids and the like. The use of such marker fluids and materials is very cumbersome and does not provide an accurate measurement of the circulating volume.

Thus, there is a need for improved methods of determining the circulating volume of a drilling fluid in a well bore and for maximizing the removal of drilling fluid deposits from the walls of the well bore prior to cementing.

SUMMARY OF THE INVENTION

The present invention provides improved methods of determining the circulating volume of a drilling fluid in a well bore and for maximizing drilling fluid displacement from the well bore when primary well cementing operations are carried out therein. The methods of the invention overcome the shortcomings of the prior art and meet the need described above.

In accordance with the methods of the present invention, circulation of the drilling fluid through the well bore is resumed after the well bore is logged and pipe has been placed therein. That is, the drilling fluid is circulated through the well bore at a flow rate and for a time period required to substantially remove the drilling solids therefrom and to stabilize the viscosity and temperature of the drilling fluid. Circulation is then continued at a selected volume flow rate and maintained at that selected flow rate until the well bore inlet pressure of the drilling fluid stabilizes. During circulation at the selected flow rate, the drilling fluid well bore inlet pressure, the drilling fluid flow rate, the viscosity of the drilling fluid, the temperature of the drilling fluid and the density of the drilling fluid are monitored. Upon stabilization of the drilling fluid well bore inlet pressure, the circulating volume of the drilling fluid in the well bore is calculated based on the stabilized well bore inlet pressure, the well bore discharge pressure, the drilling fluid volume flow rate and the other properties of the drilling fluid mentioned above, i.e., viscosity, temperature and density.

The calculation of drilling fluid circulating volume in accordance with the method of this invention is based on the well known Fanning equation $$F = \frac{32fLQ^2}{\pi^2 g_c D^5} \quad (1)$$

wherein:

F is the friction loss in the conduit,
f is the Fanning friction factor,
L is the length of the conduit,
Q is the volume rate of flow,
$g_c$ is a dimensional constant, and
D is the diameter of the conduit.

The Fanning equation (1) is set out in "Perry's Chemical Engineers' Handbook," 6th Edition, 1984 at page 5-24, equation (5-57). Perry's further states at page 5-24 with respect to the above equation (1) that $$\Delta P = F\rho \quad (2)$$

wherein:

$\Delta P$ is the pressure drop in the conduit due to friction, and $\rho$ is the density of the flowing fluid.

By combining equations (1) and (2), above, it is apparent that $$\Delta P = \frac{32 f L Q^2 \rho}{\pi^2 g_c D^5} \quad (3)$$

Solving equation (3) for D reveals that $$D = \sqrt[5]{\frac{32 f L Q^2 \rho}{\pi^2 g_c \Delta P}} \quad (4)$$

In addition to the above, it is well known that the volume, V, of a conduit is expressed by the formula $$V = \left(\frac{\pi D^2}{4}\right) L \quad (5)$$

Accordingly, solving equation (5) for D obtains $$D = \sqrt[2]{\frac{4V}{\pi L}} \quad (6)$$

and substituting equation (6) in equation (4) and solving for V reveals $$V = \frac{\left(\sqrt[5]{\frac{32 f L Q^2 \rho}{\pi^2 g_c \Delta P}}\right)^2}{4} \pi L \quad (7)$$

Equation (7) is, accordingly, the general equation employed herein to calculate the drilling fluid circulating volume.

The term, "$g_c$," in the above equations, is defined in "Perry's" as a dimensional constant. The term is also called a "gravitational conversion factor" and can have a value of 32.174 ($lb_m/lb_f$) (ft/sec$^2$). See page 7, of "Transport Phenomena," Bird, et al., 1960. It is understood that the units of the various terms in equations (1)–(7) are consistent with the units in $g_c$.

When performing the methods of this invention for maximizing the removal or displacement of drilling fluid deposits, including partially dehydrated drilling fluid and filter cake, from the walls of the well bore when performing primary cementing therein, the drilling fluid is circulated at several different constant volume flow rates wherein each of the constant flow rates is maintained for the time required to permit the drilling fluid well bore inlet pressure to stabilize at which time the well bore inlet pressure, the well bore discharge pressure, the drilling fluid volume flow rate and the viscosity, temperature and density of the drilling fluid are recorded. The drilling fluid circulating volume in the well bore at each of the constant flow rates is calculated as described below based on the stabilized drilling fluid well bore inlet and discharge pressures, the drilling fluid volume flow rate and the other recorded drilling fluid properties by using the general relationship set forth in equation (7) above. The calculated drilling fluid volumes are then compared. Differences in the calculated volumes, caused by differences in the drilling fluid constant volume flow rates, provide a measure of the erosion and removal of the partially dehydrated drilling fluid and the filter cake from the walls of the well bore.

An increase in the calculated drilling fluid circulating volume caused by an increase in volume flow rate is an indication of an increase in the removal of material deposited on the wall of the bore hole. If there is no deposited material to be removed, then an increase in volume flow rate will produce a pressure increase in the well bore but will not produce an increase in calculated circulating volume. Accordingly, by this method, the volume flow rate can be optimized to maximize the removal of deposited material. It will be appreciated that increases in borehole pressure may produce a hydraulic fracture in a subterranean formation penetrated by the well bore. Volumetric flow rates which create potential fracture pressures are to be avoided.

Once an optimum volume flow rate has been determined, the drilling fluid is circulated at that flow rate, or at a flow rate as close as possible to that flow rate to avoid hydraulically fracturing of penetrated subterranean formations, and then the drilling fluid is displaced from the well bore at that same flow rate as a cement slurry is placed therein.

Thus, it is an object of the present invention to provide methods of determining the circulating volume of a drilling fluid in a well bore based on the drilling fluid well bore inlet pressure, the circulating drilling fluid flow rate and other properties of the drilling fluid constant volume which are monitored at the well head.

A further object of the present invention is the provision of methods of maximizing drilling fluid displacement from the well bore during the performance of primary cementing.

Other and further objects, features and advantages of the present invention will be readily apparent to those skilled in the art upon a reading of the description of preferred embodiments which follows.

DESCRIPTION OF PREFERRED EMBODIMENTS

Well bores are most commonly drilled using a rotary bit connected to a string of drill pipe. The drill pipe and bit are rotated and a drilling fluid, generally a hydrocarbon base fluid or an aqueous gel with or without weighting material suspended therein, e.g., an aqueous solution of a clay such as bentonite containing particulate weighting material such as barite, is circulated downwardly through the drill pipe, through ports in the drill bit and then upwardly through the annulus between the drill pipe and walls of the well bore to the surface. The drilling fluid carries cuttings produced by the drill bit to the surface which are separated from the drilling fluid. A reservoir of circulating drilling fluid is maintained on the surface and the drilling fluid is pumped from the reservoir by circulating pumps back into the drill string. During drilling, the properties of the drilling fluid, including viscosity and density, are monitored to insure that drilling fluid properties remain within desired limits. When the well bore has reached its desired depth, drilling and the circulation of drilling fluid are stopped, the drill pipe and bit are removed from the well bore, subterranean formations penetrated by the well bore are generally logged and pipe (the casing) to be cemented in the well bore is run therein.

During the time that the drilling fluid remains in the uncased well bore, i.e., the open hole, without being circulated, relatively low viscosity fluid, i.e., water, is lost from the drilling fluid into permeable formations penetrated by the well bore. As a result of the loss of water, filter cake comprised of weighting material and other solids from the drilling fluid is deposited on the walls of the well bore along with partially dehydrated gelled drilling fluid which, in addition to developing gel strength in the absence of shear caused by lack of circulation, has also lost a portion of its water. In addition, the drilling fluid near the casing develops gel strength in the absence of shear.

After the pipe to be cemented has been run into the well bore, a primary cementing operation is performed whereby the drilling fluid in the well bore can be displaced out of the well bore by one or more liquid spacers which are pumped downwardly through the pipe and then upwardly into the annulus between the pipe and the walls of the well bore followed by a cement slurry. The cement slurry hardens into a substantially impermeable solid mass in the annulus to seal the annulus whereby formation fluids are prevented from flowing in the annulus between subterranean zones penetrated by the well bore and/or to the surface.

In order to produce a successful cement seal in the annulus, the drilling fluid, and major portions of the filter cake and partially dehydrated gelled drilling fluid deposited on the walls of the well bore, must be removed therefrom prior to placement of the cement slurry in the annulus. If a substantial quantity of filter cake and gelled drilling fluid are allowed to remain on the walls of the well bore when the cement slurry is placed, the cement slurry will not bond to the walls of the well bore and the annulus will not be sealed.

The present invention provides improved methods of determining the circulating volume of drilling fluid in a well bore and of maximizing the removal of the filter cake and gelled drilling fluid deposited on the walls of the well bore prior to placement of the cement slurry in the well bore.

The method of determining the circulating volume of drilling fluid in a well bore in accordance with the present invention, i.e., determining the volume of drilling fluid which is circulating through the well bore, is generally carried out after the circulation of the drilling fluid through the well bore has been restarted and stabilized. That is, after the pipe to be cemented has been run in the well bore, the circulation of the drilling fluid is started and continued for the period of time required for drilling solids to be removed therefrom and for the viscosity and temperature of the drilling fluid to stabilize. This initial circulation causes moderately gelled drilling fluid contained within the well bore to be sheared and thinned out and shear stress to be applied to the walls of the well bore by the flowing drilling fluid whereby portions of the partially dehydrated gelled drilling fluid and filter cake deposited on the walls of the well bore are eroded therefrom and combined with the circulating drilling fluid. At the end of the initial circulation when the drilling fluid properties and the erosion process have stabilized, substantial portions of filter cake and partially dehydrated gelled drilling fluid usually remain on the walls of the well bore.

In order to determine the circulating volume of drilling fluid and to estimate the quantity of material deposited on the walls of the well bore the following steps are performed. First, the circulation of the drilling fluid is continued at a selected constant volume flow rate which is maintained until the well bore inlet pressure of the drilling fluid stabilizes. Upon stabilization the well bore inlet and outlet pressures, the drilling fluid constant volume flow rate, the viscosity of the drilling fluid, the temperature of drilling fluid, and the density of the drilling fluid are recorded. That is, the pressure differential required to circulate the drilling fluid through the well bore changes in accordance with changes in the viscosity, temperature and density of the drilling fluid and in accordance with diameter. (See equation (3) above.)

In addition, a particular flow rate of drilling fluid applies a particular shear stress on the walls of the well bore having filter cake and gelled filter cake deposited thereon. Thus, when the drilling fluid flow rate is increased the shear stress is increased and a portion of the gelled drilling fluid and/or filter cake can be eroded from the walls of the well bore and combined with the flowing drilling fluid. Accordingly, when the circulation at the selected constant volume flow rate is maintained for the time required for the drilling fluid well bore inlet pressure to stabilize, erosion of the filter cake and gelled drilling fluid on the walls of the well bore stops, no further deposit is removed and, in addition, the viscosity, temperature and density of the drilling fluid stabilize.

When the circulating drilling fluid reaches equilibrium, that is, when the well head drilling fluid inlet pressure stabilizes, the circulating volume of drilling fluid in the well bore is calculated by using the recorded values of stabilized well bore inlet pressure, the discharge pressure, the selected volume flow rate at which the drilling fluid is circulating and the other recorded properties of the drilling fluid, i.e., viscosity, temperature and density.

The above values are then substituted into the above given general equations (3), (4), and (5) or (3) and (7) in accordance with the following procedure.

The difference between the recorded inlet pressure and discharge pressure is the total pressure drop experienced by the stabilized circulating drilling fluid. This difference is expressed as follows:

$$\Delta PT_T = P_s - P_d \tag{8}$$

wherein $\Delta P_T$ is the total pressure drop, $P_s$ is the stabilized inlet pressure, and $P_d$ is the outlet, or discharge, pressure.

The total pressure drop can also be viewed as the sum of all the pressure drops experienced by the drilling fluid as it traverses the various components of the well between the surface inlet and discharge. Since each well may differ with respect to the pressure loss components to be considered, the following expression is general and is provided for guidance and by way of example, thus:

$$\Delta P_T = \Delta P_{pip} + \Delta P_{cas} + \Delta P_{fsc} + \Delta P_{cc} + \Delta P_{cat} + \Delta P_{CH} + \Delta P_{OH} \tag{9}$$

wherein:

$\Delta P_{pip}$ is the pressure drop in the piping between the inlet transducer and the casing head, $\Delta P_{cas}$ is the pressure drop in the casing between the casing head and float shoe;

$\Delta P_{fsc}$ is the pressure drop caused by the float shoe;

$\Delta P_{cc}$ is the pressure drop in the annulus caused by casing collars;

$\Delta P_{cat}$ is the pressure drop caused by casing attachments such as centralizers;

$\Delta P_{CH}$ is the pressure drop in a cased portion of the annulus (if any); and $\Delta P_{OH}$ is the pressure drop in the uncased (open hole) portion of the annulus.

All of the various individual pressure drops alluded to the above, except $\Delta P_{OH}$, can be solved directly by use of known equations, such as equation (3), above. $\Delta P_{OH}$, which is the element of interest herein, can be determined by combining equations (8) and (9) and solving for $\Delta P_{OH}$ as follows:

$$\Delta P_{OH}=\Delta P_T-(\Delta P_{pip}+\Delta P_{cas}+\Delta P_{fsc}+\Delta P_{cc}+\Delta P_{cat}+\Delta P_{CH}) \quad (10)$$

The individual pressure drops on the right side of equation (10) which involve circular conduits such as, $\Delta P_{pip}$ and $\Delta P_{cas}$, can be solved directly using equation (3) wherein friction factor, f, is determined in the usual manner by use of Reynolds Number, $N_{RE}$, as explained in Perry's Handbook referred to above.

The individual pressure drops on the right side of equation (10), which involve annular spaces and non-circular cross sections, such as $\Delta P_{CH}$, can be solved directly by using equation (3), wherein D is a hydraulic diameter calculated by known means and f is determined in the usual manner.

The individual pressure drops on the right side of equation (10) which involve items which are not conduits, such as $\Delta P_{fsc}$, $\Delta P_{cc}$ and $\Delta P_{CAT}$, can be determined by use of specialized equations supplied from vendors of the items; or by the use of equation (3), wherein L and D are "equivalent values" supplied by vendors of the items; or by laboratory experimentation; or the values can be supplied directly by the vendors of the items for insertion in equation (10).

When the elements of the right side of equation (10) are determined, then $\Delta P_{OH}$ can be determined directly and then substituted in equation (4) to determine $D_{OH}$, which is the hydraulic diameter of the annular space of the open hole.

With respect to the use of equation (4), to calculate $D_{OH}$, all of the terms of the right side of equation (4), including the length, $L_{OH}$, of the open hole will be known except for the value of friction factor, f.

The value of $D_{OH}$ cannot be determined directly by use of equation (4) because the value of friction factor, f, to be employed in equation (4), depends, in part, on the value of $D_{OH}$. Accordingly, the determination of $D_{OH}$ using equation (4) involves a trial and error procedure wherein the value of $D_{OH}$ is assumed, from which assumption the value of f is calculated. The calculated value of f is then substituted into equation (4) which permits the calculation of $D_{OH}$. The assumed value of $D_{OH}$ and the calculated value of $D_{OH}$ are compared. If the difference between the assumed value and calculated value is greater than a limit to be specified by the user, then the procedure is repeated until the difference between the values is within the specified limit.

The calculation of $D_{OH}$, as above described, involves the use of the friction factor, f. The friction factor, f, applicable to an open hole may be calculated by any particular equation which may be preferred by a user. Examples of such equations currently preferred by Applicants are disclosed in SPE Paper 19539 by Shah and Sutton which is incorporated herein by reference.

The paper, dated Oct. 8–11, 1989, is entitled "New Friction Correlation for Cements From Pipe and Rotational Viscometer Data." Specific reference is made to equations 11, 14, 15, 16, and 17 of the above paper.

Once a satisfactory value of $D_{OH}$ is calculated the calculated value of $D_{OH}$ is substituted into equation (5) to obtain the circulation Volume, V.

It is evident from the above description of the calculation procedure, that the entire procedure must be performed for each selected constant volume flow rate. The calculation procedure, being laborious and repetitive, is an ideal candidate for computer application. Applicants herein, accordingly, prefer the use of a computer to perform the calculations and have, therefor, prepared a suitable program to be executed by computer to calculate the value of the circulating volume, V, of the drilling fluid. The particular computer program employed by Applicants forms no part of this invention.

As mentioned above, the drilling fluid well bore inlet pressure, the drilling fluid volume flow rate, the viscosity of the drilling fluid, the temperature of the drilling fluid and the density of the drilling fluid are constantly monitored during the period of drilling fluid circulation prior to displacing the drilling fluid with cement. As concerns the temperature of the drilling fluid it is preferably monitored both as it enters the well bore and as it exits the well bore. Such inlet and outlet temperatures are then used to estimate the average temperature of the drilling fluid in various zones in the well bore depending upon the geometry of the well bore and the pipe disposed therein. Also, the average drilling fluid viscosity and density in each zone in the well bore are estimated based on the temperature estimations, and the friction factors and pressure drops in each zone are calculated. All of the above described estimations and calculations are well known to those skilled in the art and are readily accomplished by computer based on the above described monitored conditions and properties of the circulating drilling fluid.

Once the stabilized circulating drilling fluid volume has been calculated, it can be compared to the total volume available in the well bore for containing drilling fluid to thereby determine the volume of drilling fluid which is not circulating, i.e., the volume of the filter cake and gelled drilling fluid deposited on the walls of the well bore. If this comparison shows that enough of the filter cake and gelled drilling fluid has been removed from the walls of the well bore by the circulating drilling fluid to permit satisfactory primary cementing, the drilling fluid is displaced from the well bore with a slurry of cement at a flow rate equal to the stabilized drilling fluid constant volume flow rate used to determine the circulating drilling fluid volume. The cement slurry is placed in the annulus between the pipe disposed in the well bore and the walls of the well bore. As is well understood, once the cement slurry has been placed in the annulus and the drilling fluid displaced therefrom, the cement slurry is allowed to set into a hard substantially impermeable mass thereby sealing the annulus.

In a preferred method of the present invention whereby the drilling fluid circulating flow rate which results in the maximum erosion and removal of filter cake and gelled drilling fluid from the walls of the well bore is determined, the following steps are performed. After the drilling fluid is initially circulated for the time necessary to clean up the drilling fluid and allow it to stabilize, the drilling fluid is circulated at three or four progressively increasing flow rates with each of said flow rates being maintained for a time period in the range of from about 0.5 hours to about 2 hours whereby the drilling fluid well bore inlet pressure stabilizes while monitoring the well bore inlet pressure, the drilling fluid constant volume flow rate and the drilling fluid properties, i.e., viscosity, temperature and density. The drilling fluid circulating volume in the well bore is calculated at each of the flow rates based on the stabilized drilling fluid well bore inlet pressure, the discharge pressure, the volume flow rate and the other monitored drilling fluid properties. The calculated drilling fluid circulating volumes are then compared with each other to determine the differences therein due to the drilling fluid flow rate increases and the increased erosion of the partially dehydrated gelled drilling fluid and the filter cake from the walls of the well bore. The total volume available in the well bore for containing drilling fluid is next compared with the calculated drilling fluid circulating volumes to thereby determine the lowest drilling fluid flow rate at which maximum portions of the partially dehydrated gelled drilling fluid and filter cake are removed from the walls of the well bore. Once such drilling fluid flow rate is determined, the drilling fluid is displaced from the well bore at that flow rate, i.e., the flow rate at which the maximum portions of gelled drilling fluid and filter cake are removed from the walls of the well bore and combined with the flowing drilling fluid.

Thus, the above described method maximizes removal of drilling fluid including partially dehydrated gelled drilling fluid and filter cake deposited on the walls of the well bore when performing primary cementing operations in the well bore.

In some applications of the methods of this invention, the drilling fluid circulating pump capacity and the geometry of the well bore and pipe disposed therein may be such that a drilling fluid circulation and displacement flow rate at which the required portions of filter cake and partially dehydrated gelled drilling fluid are eroded and removed from the well bore walls can not be reached. That is, if the drilling fluid is circulating at a flow rate which is at or near the maximum flow rate that can be pumped but does not result in the removal of the required major portions of the partially dehydrated drilling fluid and filter cake from the walls of the well bore, then additional steps must be taken to increase the shear stress exerted on the deposits beyond that exerted by the flowing drilling fluid alone. One technique which can be used to increase the shear stress is to include a spacer between the drilling fluid displaced from the well bore and the cement slurry introduced into the annulus which applies a higher shear stress on the walls of the well bore than does the drilling fluid. For example, a low viscosity fluid, such as water, can be utilized as the spacer which is in turbulent flow at the maximum displacement flow rate that can be utilized and as a result applies a high shear stress to the walls of the well bore. Alternatively, a spacer fluid having a higher viscosity than the drilling fluid can be used which produces a higher pressure drop and higher shear stress.

Another technique which can be used alone or in combination with one or more spacer fluids involves movement of the pipe to be cemented in the well bore during displacement of the drilling fluid and placement of the cement composition in the annulus. Such movement can include the rotation or reciprocation of the pipe, or both, which in turn causes the drilling fluid to apply a higher shear stress on the walls of the well bore. Mechanical means such as turbulators or scratchers can also be used to increase the removal of the gelled drilling fluid and filter cake.

In order to further illustrate the methods of the present invention, the following example is given.

What is claimed is:

1. A method of determining the circulating volume of gelled drilling fluid in a well bore excluding gelled drilling fluid and filter cake deposited on the walls of the well bore comprising the steps of:

(a) circulating said drilling fluid through said well bore at a selected constant volume flow rate and maintaining said flow rate for a time period whereby the well bore inlet pressure of said drilling fluid stabilizes while monitoring said well bore inlet pressure, said flow rate, the viscosity of said drilling fluid, the temperature of said drilling fluid and the density of said drilling fluid; and (b) calculating the circulating volume of said drilling fluid in said well bore based on said stabilized well bore inlet pressure, said flow rate, said viscosity, said temperature and said density.

2. The method of claim 1 wherein said circulating volume of drilling fluid calculated in accordance with step (b) is based on the following relationship:

$$V = \frac{\left(\sqrt[5]{\frac{32 f L Q^2 \rho}{\pi^2 g_c \Delta P}}\right)^2}{4} \pi L$$

wherein:

V represents the circulating volume, f represents the friction factor of the drilling fluid based on the drilling fluid viscosity and temperature determined in step (a), L represents the length of flowing area, Q represents said selected volume flow rate of the drilling fluid determined in step (a), $\rho$ represents the drilling fluid density determined in step (a), $g_c$ represents a dimensional constant, and

66 P represents the pressure drop due to friction with step (a), where the above variables are in consistent units.

3. The method of claim 1 which further comprises the step of comparing the total volume available in said well bore for containing drilling fluid with said calculated drilling fluid circulating volume to thereby determine if the selected flow rate of step (a) result in the removal of a major portion of said gelled drilling fluid and filter cake deposited on the walls of said well bore.

4. The method of claim 1 which further comprises the steps of:

circulating said drilling fluid at progressively increasing flow rates and maintaining each of said flow rates for a time period whereby the drilling fluid well bore inlet pressure stabilizes while monitoring said well bore inlet pressure, said flow rate, the viscosity of said drilling fluid, the temperature of said drilling fluid and the density of said drilling fluid;

calculating the drilling fluid calculating volume in said well bore at each of said flow rates based on the stabilized drilling fluid well bore inlet pressure, said flow rate, said viscosity, said temperature and said density;

comparing the calculated drilling fluid circulating volumes with each other to determine the differences therein due to increasing the drilling fluid flow rate and thereby increasing the erosion of said gelled drilling fluid and said filter cake from the walls of said well bore; and comparing the total volume available in said well bore for containing drilling fluid with said calculated drilling fluid circulating volumes to thereby determine the flow rate at which the maximum portions of said gelled drilling fluid and filter cake are removed from the walls of said well bore.

5. The method of claim 4 which further comprises the step of:

displacing said drilling fluid from said well bore at the flow rate at which said maximum portions of said gelled drilling fluid and filter cake are removed from the walls of said well bore while placing a cement slurry in said well bore.

6. A method of maximizing removal of drilling fluid when performing primary cementing in the annulus between a pipe disposed in a well bore and the walls of the well bore including gelled drilling fluid and filter cake deposited on the walls of the well bore comprising the steps of:

(a) circulating said drilling fluid through said well bore at selected progressively increasing volume flow rates and maintaining each of said flow rates for a time period whereby the drilling fluid well bore inlet pressure stabilizes while monitoring said well bore inlet pressure, said flow rate, the viscosity of said drilling fluid, the temperature of said drilling fluid and the density of said drilling fluid;

(b) calculating the drilling fluid circulating volumes in said well bore at each of said flow rates based on the stabilized drilling fluid well bore inlet pressure, said flow rate, said viscosity, said temperature and said density;

(c) comparing the drilling fluid circulating volumes calculated in accordance with step (b) with each other to determine the differences therein due to increasing the drilling fluid flow rate and thereby increasing the erosion of said gelled drilling fluid and said filter cake from the walls of said well bore;

(d) comparing the total volume available in said well bore for containing drilling fluid with said drilling fluid circulating volumes determined in accordance with step (b) to thereby determine the lowest flow rate at which maximum portions of said gelled drilling fluid and filter cake are removed from the walls of said well bore; and (e) displacing said drilling fluid from said well bore at the flow rate determined in accordance with step (a) while placing a cement slurry into said annulus between said pipe disposed therein and the walls of said well bore.

7. The method of claim 6 wherein said circulating volumes of drilling fluid calculated in accordance with step (b) are based on the following relationship:

$$V = \frac{\left(\sqrt[5]{\frac{32 f L Q^2 \rho}{\pi^2 g_c \Delta P}}\right)^2}{4} \pi L$$

wherein:

V represents the circulating volume, f represents the friction factor of the drilling fluid based on the drilling fluid viscosity and temperature determined in step (a), L represents the length of flowing area, Q represents said selected volume flow rate of the drilling fluid determined in step (a), $\rho$ represents the drilling fluid density determined in step (a), $g_c$ represents a dimensional constant, and $\Delta P$ represents the pressure drop due to friction where the above variables are in consistent units.

8. The method of claim 6 wherein said drilling fluid is an aqueous bentonite fluid containing particulate solid weighting material.

9. The method of claim 6 wherein said drilling fluid is circulated at three or four progressively increasing flow rates in accordance with step (a).

10. The method of claim 9 wherein each of said flow rates is maintained for a time period in the range of from about 0.5 hours to about 2 hours.

11. The method of claim 6 wherein said drilling fluid is displaced from said well bore by pumping said cement slurry into said well bore at said flow rate at which maximum portions of said gelled drilling fluid and filter cake are removed from the walls of said well bore.

12. The method of claim 11 wherein a spacer fluid which exerts a high shear stress on said gelled drilling fluid and filter cake deposited on the walls of said well bore is pumped between said drilling fluid and said cement slurry.

13. The method of claim 11 wherein said pipe displaced in said well bore is moved while said drilling fluid is displaced from said well bore to promote the erosion of said gelled drilling fluid and filter cake from the walls of said well bore.

14. A method of maximizing removal of drilling fluid from a well bore when performing primary cementing in the annulus between a pipe disposed in the well bore and the walls thereof including gelled drilling fluid and filter cake deposited on the walls of the well bore comprising the steps of:

(a) circulating said drilling fluid through said well bore while removing drilling solids therefrom at a flow rate and for a time period required to substantially remove solids and gas from said drilling fluid and to stabilize the viscosity and temperature thereof;

(b) continuing circulating said drilling fluid through said well bore at selected progressively increasing volume flow rates and maintaining each of said flow rates for a time period whereby the drilling fluid well bore inlet pressure stabilizes while monitoring said well bore inlet pressure, said flow rate, the viscosity of said drilling fluid, the temperature of said drilling fluid and the density of said drilling fluid;

(c) calculating the drilling fluid circulating volumes in said well bore at each of said flow rates based on the stabilized drilling fluid well bore inlet pressure, said flow rate, said viscosity, said temperature and said density;

(d) comparing the calculated drilling fluid circulating volumes determined in accordance with step (c) with each other to determine the differences therein due to increasing the drilling fluid flow rate and thereby increasing the erosion of said gelled drilling fluid and said filter cake from the walls of said well bore;

(e) comparing the total volume available in said well bore for containing drilling fluid with said drilling fluid circulating volumes calculated in accordance with step (c) to thereby determine the lowest flow rate at which the maximum portions of said partially dehydrated drilling fluid and filter cake are removed from the walls of said well bore; and (f) displacing said drilling fluid from said well bore at the flow rate determined in accordance with step (e) while placing a cement slurry in said well bore.

15. The method of claim 14 wherein said circulating volumes of drilling fluid calculated in accordance with step (c) is based on the following relationship:

$$V = \frac{\left(\sqrt[5]{\frac{32 f L Q^2 \rho}{\pi^2 g_c \Delta P}}\right)^2}{4} \pi L$$

wherein:

V represents the circulating volume, f represents the friction factor of the drilling fluid based on the drilling fluid viscosity and temperature determined in step (b), L represents the length of flowing area, Q represents said selected volume flow rate of the drilling fluid determined in step (b), $\rho$ represents the drilling fluid density determined in step (b), $g_c$ represents a dimensional constant, and $\Delta P$ represents the pressure drop due to friction where the above variables are in consistent units.

16. The method of claim 14 wherein said drilling fluid is an aqueous bentonite fluid containing particulate solid weighting material.

17. The method of claim 14 wherein said drilling fluid is circulated at three or four progressively increasing flow rates in accordance with step (b).

18. The method of claim 14 wherein said drilling fluid is displaced from said well bore by pumping said cement slurry into said well bore and into said annulus at said flow rate at which said maximum portions of said gelled drilling fluid and filter cake are removed from the walls of said well bore.

19. The method of claim 18 wherein a spacer fluid which exerts a high shear stress on said gelled drilling fluid and filter cake deposited on the walls of said well bore is pumped between said drilling fluid and said cement slurry.

20. The method of claim 19 wherein said pipe disposed in said well bore is moved while said drilling fluid is displaced from said well bore to further promote the erosion of said gelled drilling fluid and filter cake from the walls of said well bore.

* * * * *